US009312065B2

(12) United States Patent
Tedore

(10) Patent No.: US 9,312,065 B2
(45) Date of Patent: Apr. 12, 2016

(54) MACHINE FOR MANUFACTURING LAMINATIONS FOR A MAGNETIC CORE

(75) Inventor: Peter Tedore, Gulfview Heights (AU)

(73) Assignee: AEM CORES PTY LTD, Gillman (AU)

( * ) Notice: Subject to any disclaimer, the term of this patent is extended or adjusted under 35 U.S.C. 154(b) by 375 days.

(21) Appl. No.: 14/006,738

(22) PCT Filed: Jun. 21, 2011

(86) PCT No.: PCT/AU2011/000757

§ 371 (c)(1),
(2), (4) Date: Oct. 23, 2013

(87) PCT Pub. No.: WO2012/126034

PCT Pub. Date: Sep. 27, 2012

(65) Prior Publication Data

US 2014/0110062 A1 Apr. 24, 2014

(30) Foreign Application Priority Data

Mar. 24, 2011 (AU) ..... 2011901086

(51) Int. Cl.
*H01F 41/02* (2006.01)

(52) U.S. Cl.
CPC ..... *H01F 41/0213* (2013.01)

(58) Field of Classification Search
CPC . H01F 41/02; H01F 41/0206; H01F 41/0213; B29C 53/56; B29C 66/43; Y10T 156/1052; Y10T 156/1317; Y10T 156/1333
See application file for complete search history.

(56) References Cited

U.S. PATENT DOCUMENTS

| | | | |
|---|---|---|---|
| 3,034,203 | A | 5/1962 | Vienneau et al. |
| 3,081,962 | A | 3/1963 | Olsen et al. |
| 3,096,568 | A | 7/1963 | Biggs et al. |
| 3,096,805 | A | 7/1963 | Biggs et al. |
| 3,251,208 | A | 5/1966 | Mittermaier |
| 3,307,132 | A | 2/1967 | Ellis |
| 3,451,130 | A | 6/1969 | Ellis |
| 3,453,726 | A | 7/1969 | Roen |
| 3,514,836 | A | 6/1970 | Mason |
| 3,875,787 | A | 4/1975 | Mescheryakov |
| 4,953,286 | A | 9/1990 | Boenitz |
| 6,473,961 | B1 | 11/2002 | Segal et al. |
| 6,855,284 | B2 | 2/2005 | Lanni et al. |
| 7,199,696 | B2 | 4/2007 | Pauley, Jr. et al. |
| 2011/0024051 | A1 | 2/2011 | Sanford et al. |

*Primary Examiner* — Mark A Osele
*Assistant Examiner* — Christopher C Caillouet
(74) *Attorney, Agent, or Firm* — Erickson Kernell Derusseau & Kleypas, LLC

(57) ABSTRACT

A machine (10) for manufacturing stackable laminations (4) for a magnetic core (6) is disclosed. The laminations are formed from a magnetic strip material (2). The machine (10) includes a first electromechanical cam drive for actuating a folder that folds the strip material (2) and a second electromechanical cam drive for actuating a cutter that cuts the strip material (2). The folder and the cutter are independently drivable between an uppermost position and a lowermost position. The folder may include a folder platen (130) having an associated folder bar (150) to fold said strip material (2). The cutter may include a guillotine platen (230) having an associated upper cutting blade (245) that cooperates with a fixed lower blade (255) for cutting said strip material (2). The electromechanical cam drive may include any suitable electric actuator (100,200) such as an electric motor.

13 Claims, 16 Drawing Sheets

MACHINE FOR MANUFACTURING LAMINATIONS FOR A MAGNETIC CORE

FIELD OF THE INVENTION

The present invention relates to the manufacture of magnetic cores, and in particular, to the manufacture of cores formed by stacking together individual laminations of a magnetic strip material. Stacked cores are often used in transformers to provide a path for the magnetic lines of flux.

BACKGROUND OF THE INVENTION

Transformer cores are produced for a variety of applications including general purpose and distribution transformers such as those used in electricity distribution networks to step the transmitted voltage up and down to appropriate levels. Transformer cores are usually formed by stacking together individual laminations which provides several benefits including increasing the resistivity of the core and reducing eddy current losses. The process of manufacturing stackable laminations may be automated by programmable machines that can perform required folding and cutting operations. As individual laminations are produced by such a machine, they are typically manually stacked or nested together by the machine operator.

In a machine for manufacturing laminations of a magnetic core, individual laminations are typically folded and cut according to predefined geometries from a continuous feed of magnetic strip material. Such a machine typically has a cutter and folding or bending means to form the laminations as desired before they are stacked together to form a core. The cutter and folder have previously been driven (actuated) hydraulically and/or pneumatically with varying degrees of success. Hydraulic and pneumatic actuation is often noisy and may result in undesired vibration levels in the machine which accelerates wear of parts and has the potential to cause damage and misalignment of key components. Having to replace parts will invariably result in machine downtime, which coupled with part replacement, can be very costly to a core manufacturer.

Pneumatic actuators often provide uncontrolled motion between mechanical stops and are most suitable for applications where point-to-point motion is required. The compressibility of the actuating fluid results in negligible system stiffness and therefore achieving accurate position control between the limits of stroke is most difficult for pneumatic actuators.

Hydraulic actuators have a large force capability and system stiffness compared to pneumatic actuators, however hydraulic systems have several inherent drawbacks. The hydraulic fluid is subject to dirt and contamination in an industrial environment and requires filtering and maintenance. There is also the possibility of fluid leakage which can lead to machine downtime and repair. Hydraulic cylinders also tend to have limited positional accuracy and repeatability as changes in temperature of the hydraulic fluid for example may lead to performance variation. A hydraulic system also tends to require more space as support elements such as pumps, a fluid supplier, a connecting piping system, the hydraulic cylinders and necessary control valves are also required.

There is therefore a need for an improved folding and cutting actuation system in machines for manufacturing laminations of a magnetic core. An object of the present invention is to ameliorate one or more of the above described difficulties or at least provide a useful alternative to arrangements of the type discussed above.

Other advantages of the present invention will become apparent from the following description, taken in connection with the accompanying drawings, wherein, by way of illustration and example, a preferred embodiment of the present invention is disclosed.

SUMMARY OF THE INVENTION

According to a first aspect of the invention there is provided a machine for manufacturing stackable laminations for a magnetic core, the laminations formed from magnetic strip material, the machine including:

- a frame for housing a folder platen assembly and a guillotine platen assembly;
- a folder platen assembly having a folder bar for folding said strip material in at least one pre-determined position;
- a guillotine platen assembly having a cutting blade for cutting said strip material at a pre-determined position;
- a first electric actuator;
- a second electric actuator;
- a first cam shaft driven by the first electric actuator and coupled to the folder platen assembly by a first linkage member, the first cam shaft rotatable about a first axis; and
- a second cam shaft driven by the second electric actuator and coupled to the guillotine platen assembly by a second linkage member, wherein, the first linkage member comprises:

- a first portion connected to the first cam shaft through a first cam bearing and a second portion connected to the folder platen assembly through a folder platen bearing, the first cam bearing bisected by a first plane perpendicular to the first axis and the folder platen bearing bisected by a second plane perpendicular to the first axis, the first and second planes offset from each other.

In one form, the second linkage member is a straight linkage member connected to the second cam shaft through a second cam bearing and to the guillotine platen assembly through a guillotine platen bearing, both the second cam bearing and the guillotine platen bearing bisected by the first plane.

In one form, the second plane is disposed forward of the first plane.

In one form, the first and second portions of the first linkage member are stepped apart.

In one form, the folder platen assembly and guillotine platen assembly are independently and reciprocally drivable between respective uppermost and lowermost positions.

In one form, the guillotine platen assembly has a movable upper cutting blade and a fixed lower cutting blade that cooperate to cut the strip material by shearing between the respective blades.

In one form, the folder platen assembly further includes a clamping member for clamping the strip material prior to folding.

In one form, the first linkage member and folder platen assembly are coupled by a first pin element.

In one form, the second linkage member and guillotine platen assembly are coupled by a second pin element.

In one form, the folder platen assembly and guillotine platen assembly locate onto a pair of shafts that are housed in laterally opposed portions of the frame.

In one form, the folder platen assembly is slidably movable along the shafts.

In one form, the guillotine platen assembly is fixedly engaged to the shafts such that the guillotine platen and shafts are movable in unison.

In one form, at least one of the first or second electric actuators is a servo motor.

BRIEF DESCRIPTION OF THE DRAWINGS

Various aspects of the present invention will be described in detail with reference to the following drawings in which.

In the following description, like reference characters designate like or corresponding parts throughout the several views of the drawings.

DESCRIPTION OF ILLUSTRATIVE EMBODIMENT

Figure 1:
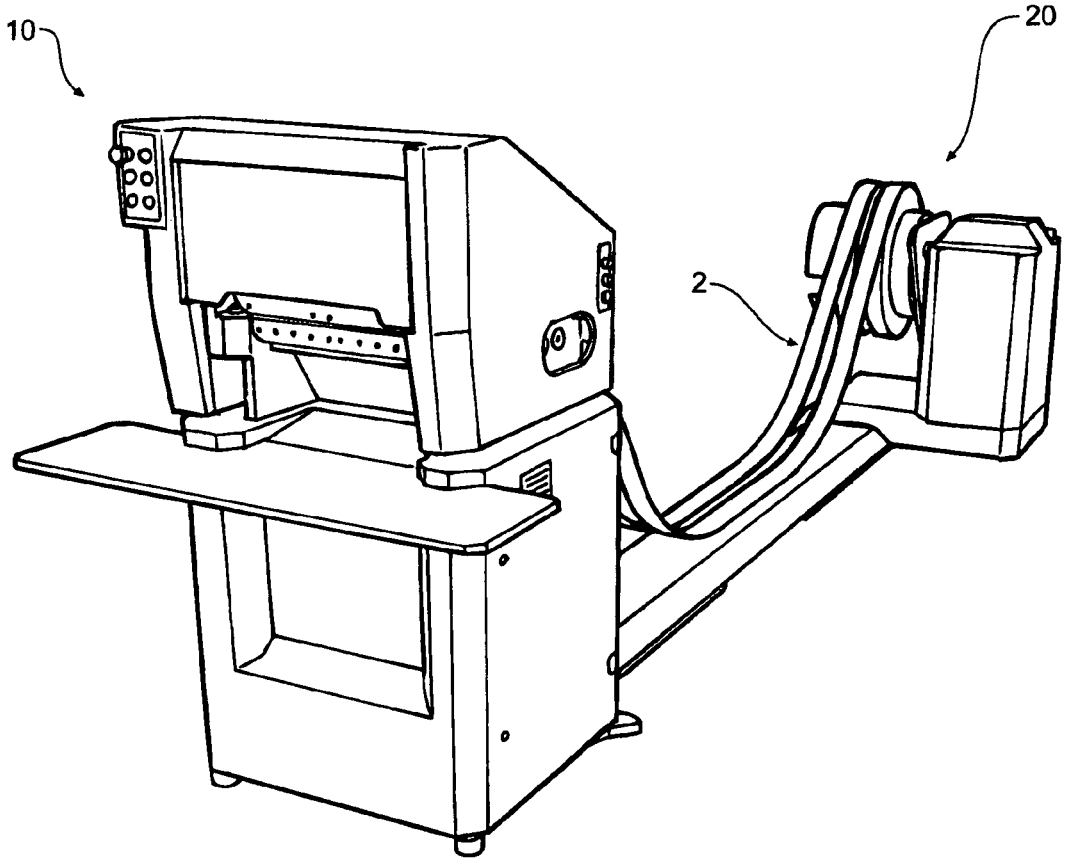
FIG. 1 is a perspective view of a machine for manufacturing laminations of a magnetic core.
Figure 2:
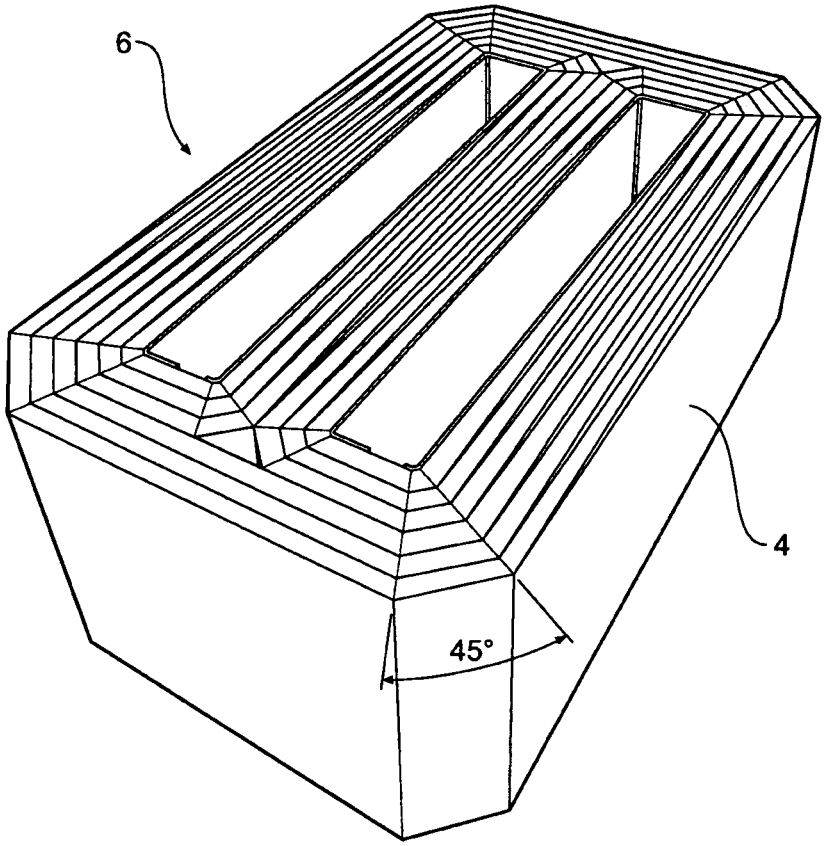
FIG. 2 is an embodiment of a magnetic core formed by stacking individual laminations manufactured by the machine.

Referring to FIG. 1, there is shown a machine 10 for manufacturing laminations of a magnetic core. FIG. 1 depicts a machine 10 in a manufacturing environment with an associated decoiler 20. A coil of magnetic strip material 2 is unwound from the decoiler 20 and fed to the machine 10, where it is folded and cut to form an individual lamination 4 of a core 6 (see FIG. 2). The machine 10 is used to manufacture laminations which are stacked or nested together to form a core, typically for use in a transformer. The machine 10 is programmable to produce a variety of user specified core geometries. An embodiment of a core 6 that may be manufactured by the machine 10 is shown in FIG. 2. The core 6 shown in FIG. 2 has been formed by stacking individual laminations 4 having 45° degree corner folds. The core 6 is formed by stacking these laminations together as each individual lamination is cut from the machine 10. The machine 10 may be configured to produce folds of varying angles including 30°, 45° and 90°.

The core 6 illustrated in FIG. 2 is just one example of a possible core geometry which can be formed by the machine 10. Cores of different configurations including standard and end-overlap Distributed Gap, DUO core, Uncut, Butt, Step Butt and 90° cut laminations are examples of core types which may be manufactured by such a machine. Programming software is used to define the geometry of the core with adjustable parameters including strip width, strip thickness, corner angle, window length, window width, and build up as will be understood by those skilled in the art. The core 6 may be made from any grade of Grain Oriented Silicon Steel (GOSS) or Non-Oriented (NO) electrical steel with thickness from 0.2 to 0.35 mm. The machine 10 is configurable to process a single strip of material or alternatively two narrower strips simultaneously.

Figure 3:
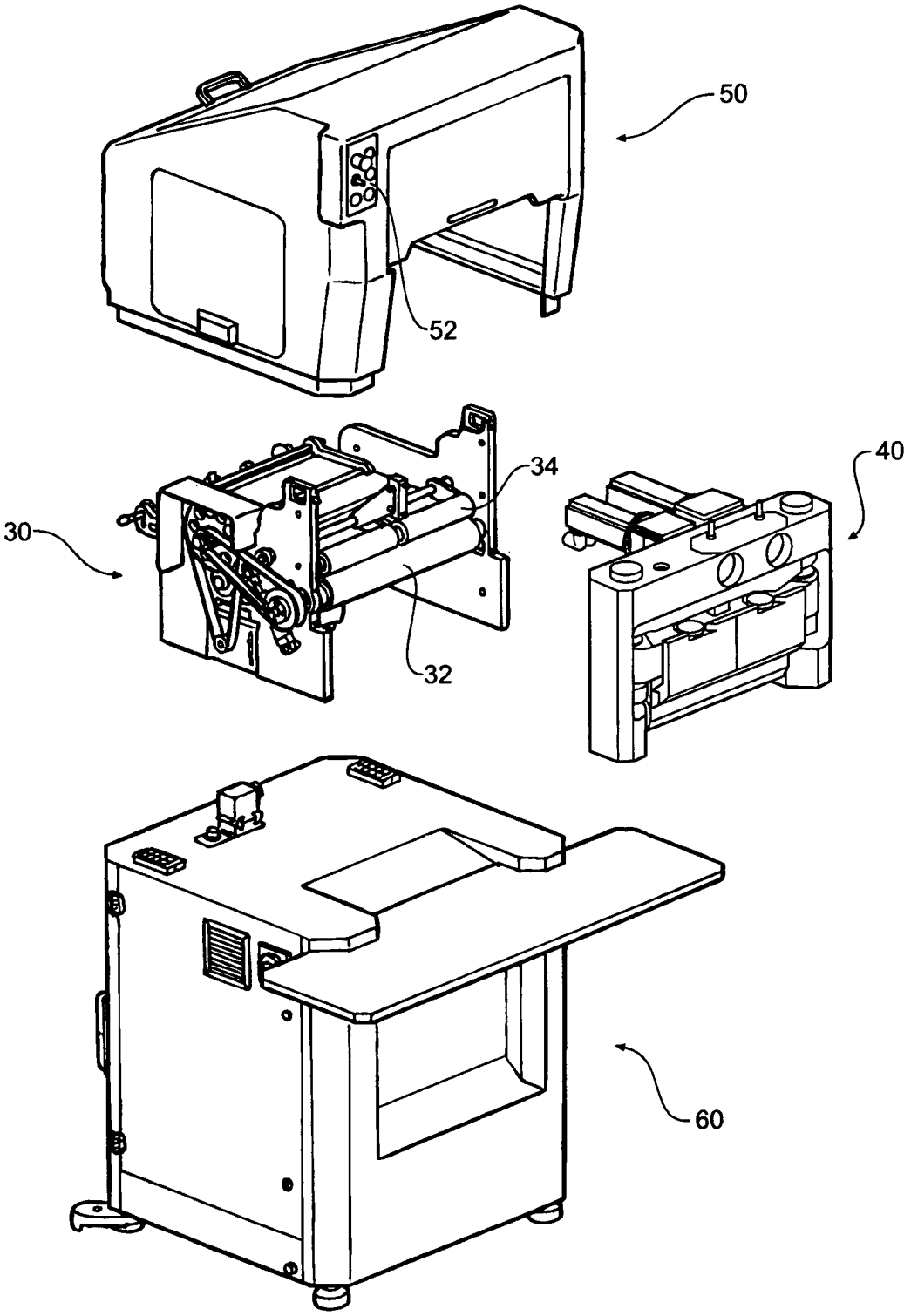
FIG. 3 is an exploded view of the main subassemblies of the machine.

Referring now to FIG. 3, there is shown an exploded view of the main subassemblies of the machine 10. A cabinet assembly 60 forms the base of the machine and houses most of the electronic equipment. Mounted upon the cabinet assembly 60 is a feed assembly 30 which receives strip material 2 from the decoiler 20. The strip material 2 is guided between lower rollers 32 and upper rollers 34 and fed to the head assembly 40 where it is folded and cut. In this manner, the machine 10 can receive at least one strip of material 2. The head assembly 40 is mounted onto the feed assembly 30 by suitable fastening means, but preferably bolted into position. There is also a hood assembly 50 that substantially encloses the feed assembly 30 and the head assembly 40. At least one user control interface 52 is mounted onto the hood assembly 50 providing machine controls such as POWER ON, STOP, RUN and HOLD.

Figure 4:
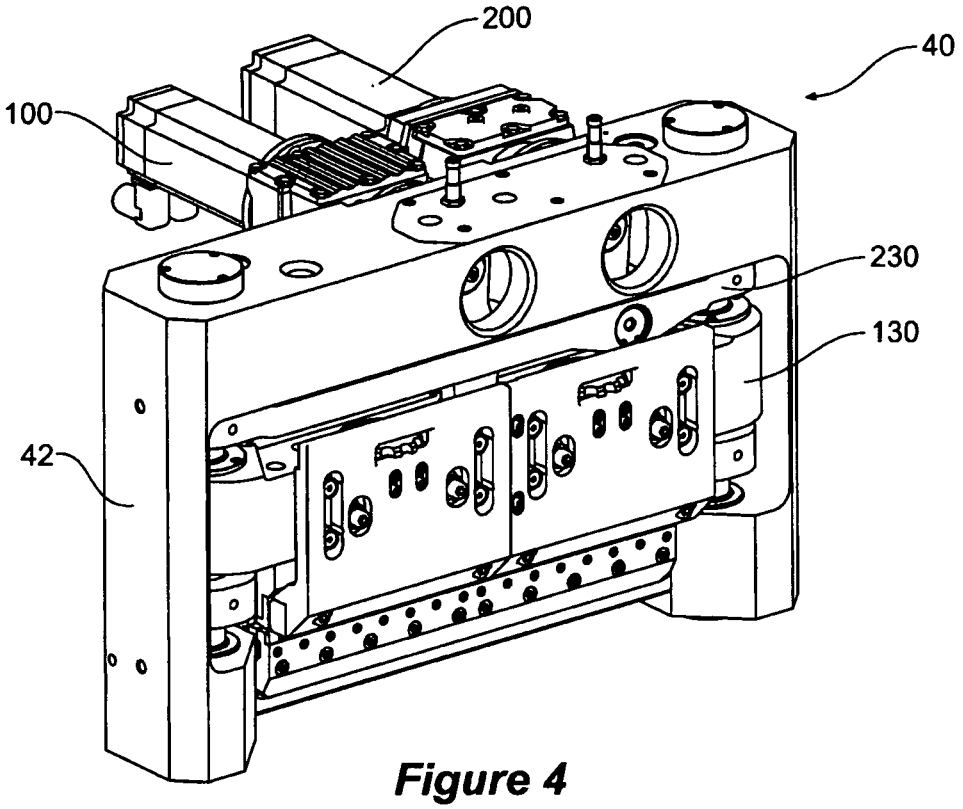
FIG. 4 is a perspective view of the head assembly of the machine.
Figure 5:
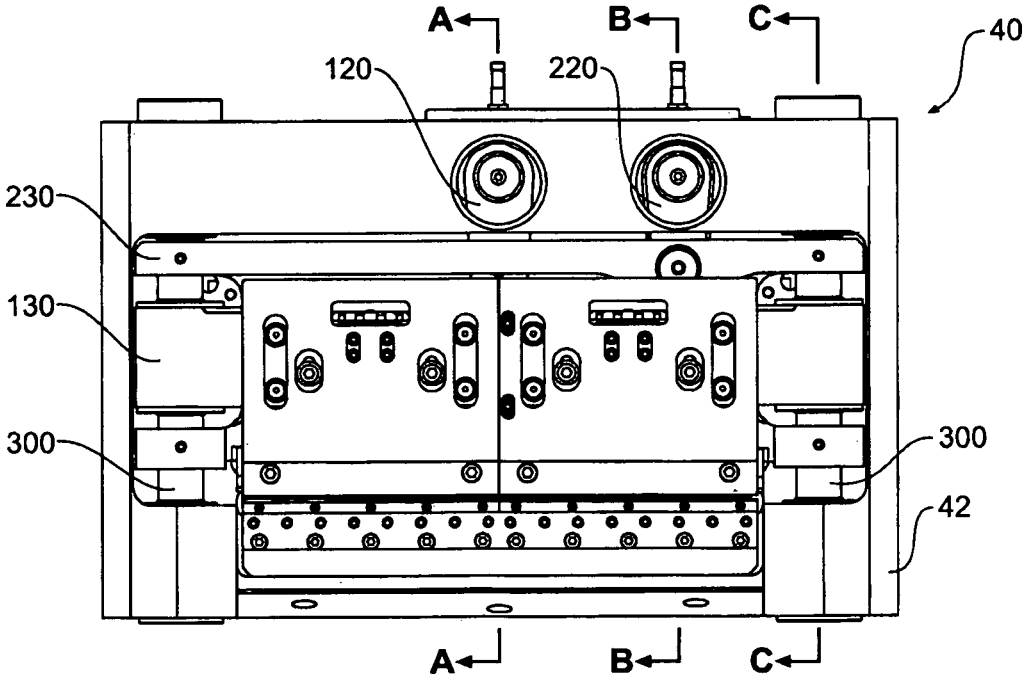
FIG. 5 is a front view of the head assembly of the machine.
Figure 6:
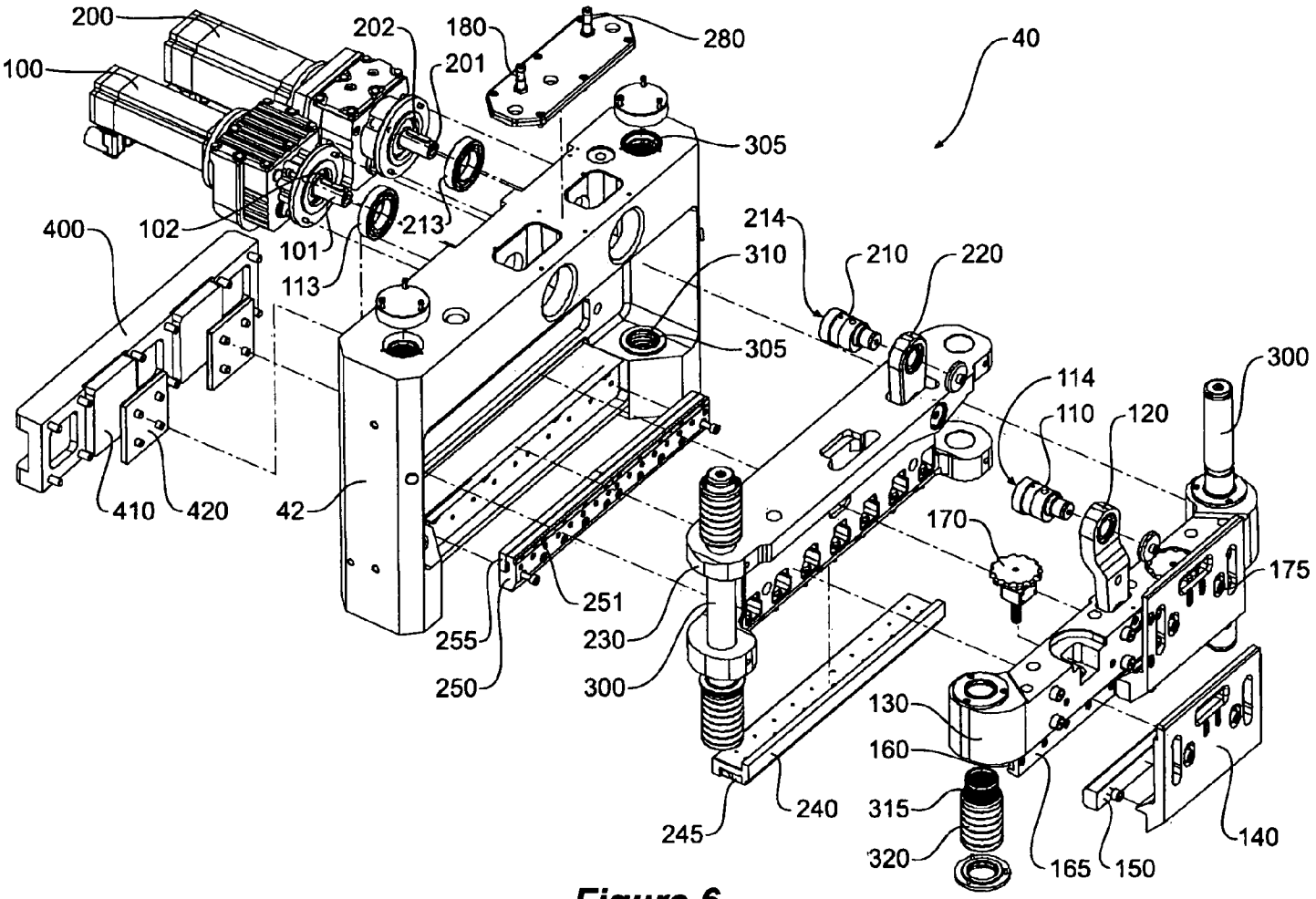
FIG. 6 is a semi-exploded view of the main components of the head assembly of the machine.

Referring now to FIGS. 4-6, there are shown views of the head assembly 40 of the machine 10. The head assembly 40 houses the components of the machine 10 that facilitate the folding and cutting of the strip material 2. The head assembly 40 is built up around a machined head frame 42 that forms the housing and support structure for the folder and cutter. FIGS. 4 and 5 provide an illustration of how the folder and cutter may be assembled within the head frame 42. The folder broadly comprises a folder platen assembly, which includes a folder platen 130, support plate 140 and folder bar 150. The folder platen 130 is located onto a pair of guide shafts 300 which are supported in laterally opposed portions of the head frame 42. The folder platen 130 is slidably engaged onto shafts 300 which guide the platen 130 up and down from an uppermost position to a lowermost position (the range of linear displacement is defined as the "stroke").

The folder platen assembly is actuated by an electromechanical cam drive system. An electric actuator 100 drives a cam shaft 110 securably engaged with a linkage member 120 that is coupled to the folder platen 130. As the folder platen 130 moves down towards the bottom of its stroke, the folder bar 150 contacts the strip material 2 and forms the programmed bend or fold. In this specification 'electromechanical' refers to an electric drive or actuator (i.e. the motive force is electric) coupled with mechanical components which thereby transmits electrical energy into mechanical motion.

The cutter broadly comprises a guillotine platen assembly, which includes a guillotine platen 230, upper blade holder 240 and upper cutting blade 245. The upper blade holder 240 is mounted to the base of the guillotine platen 230 such that the upper cutting blade 245 moves up and down with the guillotine platen 230. The guillotine platen 230 is also located on the guide shafts 300 but may be fixedly engaged. In this manner, the guillotine platen 230 and shafts 300 are movable in unison from an uppermost position to a lowermost position (the range of linear displacement is defined as the "stroke"). In alternative embodiments the guillotine platen 230 may be slidably movable with respect to the shafts 300. The guillotine platen assembly is actuated by an electromechanical cam drive system. An electric actuator 200 drives a cam shaft 210 securably engaged with a linkage member 220 that is coupled to the guillotine platen 230. As the guillotine platen 230 moves down towards the bottom of its stroke, the upper cutting blade 245 contacts the strip material 2 and cooperates with a fixed lower cutting blade 255 to cut or shear the strip material 2 clean through.

Although it is preferable that both the cutter and folder are actuated by an electromechanical cam drive arrangement, there will be instances where spatial constraints may require the folder to be pneumatically driven. For example, in a smaller variant of the machine, it may be preferable to utilize the compact arrangement of a pneumatic drive to actuate the folder platen assembly. In such an embodiment, the cutter would remain driven by an electromechanical cam arrangement, and therefore the advantages associated with this form of actuation would still be realized in the overall performance of the machine.

Figure 7:
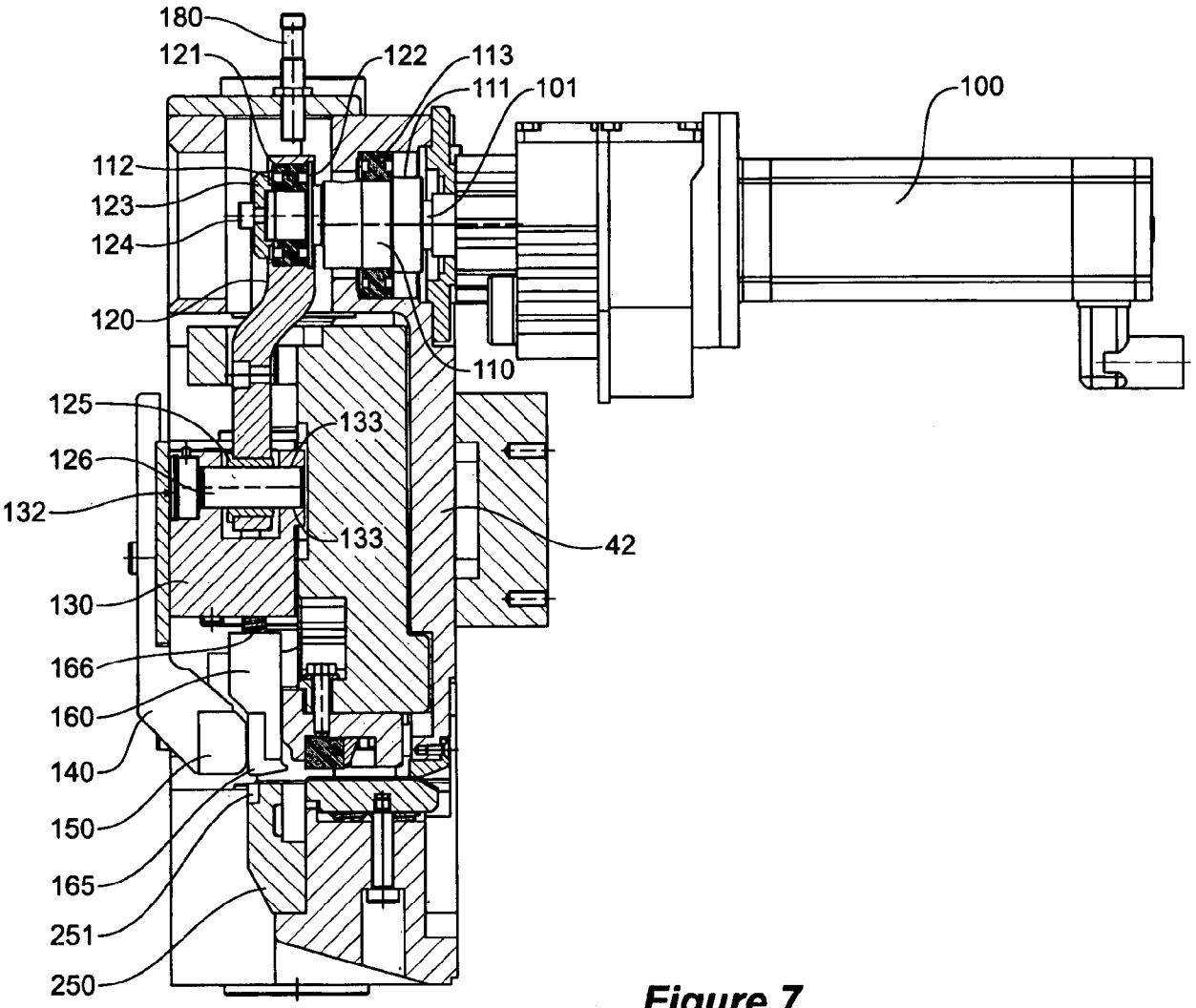
FIG. 7 is a sectional view through A-A of FIG. 5 showing the folder drive mechanism.

Referring now to FIG. 7 there is shown a sectional view through A-A of FIG. 5 through the folder drive mechanism. An electric actuator 100 is shown mounted onto the rear of the head frame 42. The electric actuator 100 may be any suitable electric motor, but preferably a servo motor. A servo motor advantageously provides the requisite level of control and accuracy while still providing sufficient power and torque. An eccentric cam shaft 110 is securably mounted onto the output shaft 101 of the servo motor 100. The output shaft 101 of the motor 100 has a raised key element 102 which slidably engages into an internal keyway (not shown) of the cam shaft 100. Through this connection the key 102 prevents relative rotation between the two parts and allows torque to be transmitted from the motor 100 to the cam shaft 110. A grub screw (not shown) is used to lock the cam shaft 110 onto the output shaft 101 of the motor 100 through a threaded hole in the cam shaft 110. The cam shaft 110 is rotatably supported by ball bearing 113 that is housed in head frame 42.

Figure 12:
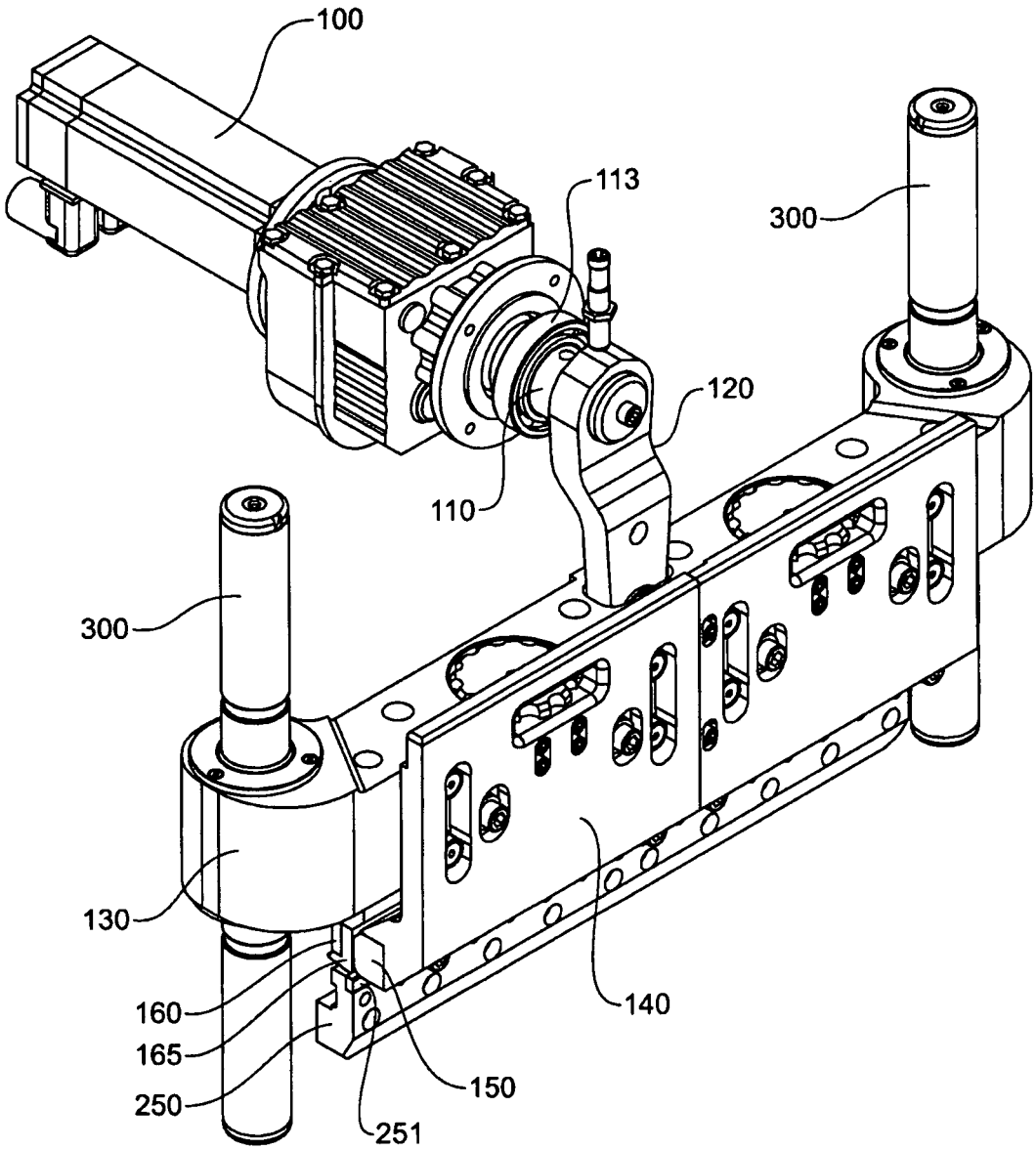
FIG. 12 is a perspective view of the head assembly showing detail of the folder drive mechanism.

The cam shaft 110 is connected to a linkage member or rocker arm 120. This connection is illustrated most clearly in FIG. 8 which shows an exploded view of the cam shaft and linkage arrangement of the folder drive. FIG. 12 also provides detail of the folder drive arrangement (with cutter drive not shown). The cam shaft 110 comprises an elongate shank portion 111 and a radially offset or eccentric cam pin 112. The linkage member 120 includes a first aperture 127 and a second aperture 128. The cam pin 112 is inserted through the first aperture 127 of the linkage member 120, and is rotatable within ball bearing 121 that is mounted within the first aperture 127 of the linkage member 120 and held by an internal circlip 122. The cam shaft 110 is secured to the linkage member 120 by a link retainer or washer 123 that is mounted onto the surface of the linkage member 120 surrounding the first aperture 127. A suitable fastener, for example a socket head screw is fastened through a threaded hole of the link retainer 123 and into a threaded hole 115 in the cam pin 112. This connection facilitates a direct coupling between the cam shaft 110 and the linkage member 120 such that as the cam shaft 110 rotates, the linkage member 120 is driven between an uppermost position and a lowermost position in a reciprocal manner.

The folder platen assembly is coupled to the linkage member 120 via a coupling element 126 that is inserted through the second aperture 128 of the linkage member 120. The coupling element 126 may be an elongate pin element. The coupling element 126 is inserted through a passageway 132 located in the folder platen 130 and is supported by a bush 125 located in the second aperture 128 of the linkage member 120. The outer surface of the coupling member 126 bears against the internal walls 133 of the passageway 132 of the folder platen 130. Therefore, as the linkage member 120 is lowered or raised, the coupling member 126 exerts a bearing force onto the passageway 132 of the folder platen 130, resulting in a lowering or lifting of the folder platen 130.

Throughout this specification, the word 'platen' is used to describe a block or ram element of sufficient mass which when driven down towards the strip material, is capable of applying the force required during the folding or cutting processes.

As the folder platen 130 is situated forward of the guillotine platen 230, in a preferred embodiment the linkage member 120 is machined with an upper portion 129*a* having the first aperture 127 stepped from a lower portion 129*b* having the second aperture 128, creating an offset in the fore-aft direction between the upper portion 129*a* and the lower portion 129*b*. Forming the linkage member in this way, enables commonality between the cam shafts of both the folder drive and the guillotine drive. If a straight linkage were used (as for the guillotine drive), the cam shaft would need to be longer which would result in higher loading at the base of the cam shaft and motor shaft which would create higher cyclical stresses and reduce the fatigue life of the components. Providing the stepped linkage member alleviates these problems and allows the first apertures of both linkages to be situated and driven in the same vertical plane.

Figure 8:
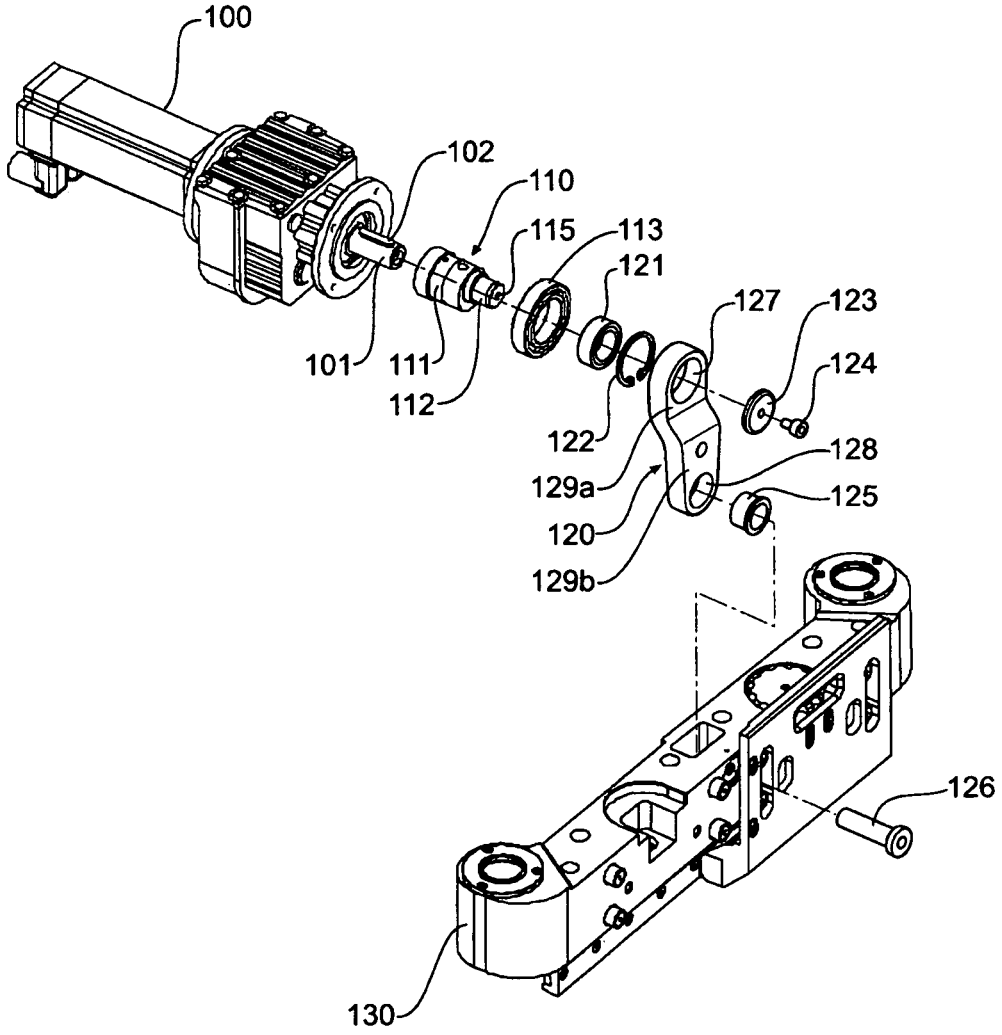
FIG. 8 is an exploded view of the cam shaft and linkage arrangement of the folder drive.

The stepped linkage member 120 (the first linkage member) is described further with reference to FIGS. 7 and 8. The first linkage member 120 has a first portion 129*a* connected to the first cam shaft 110 through a first cam bearing 121 and a second portion 129*b* connected to the folder platen assembly through a folder platen bearing 125, the first cam bearing 121 bisected by a first plane perpendicular to the axis of rotation of the first cam shaft 110 and the folder platen bearing 125 bisected by a second plane perpendicular to the axis of rotation of the first cam shaft 110, the first and second planes offset from each other.

Figure 10:
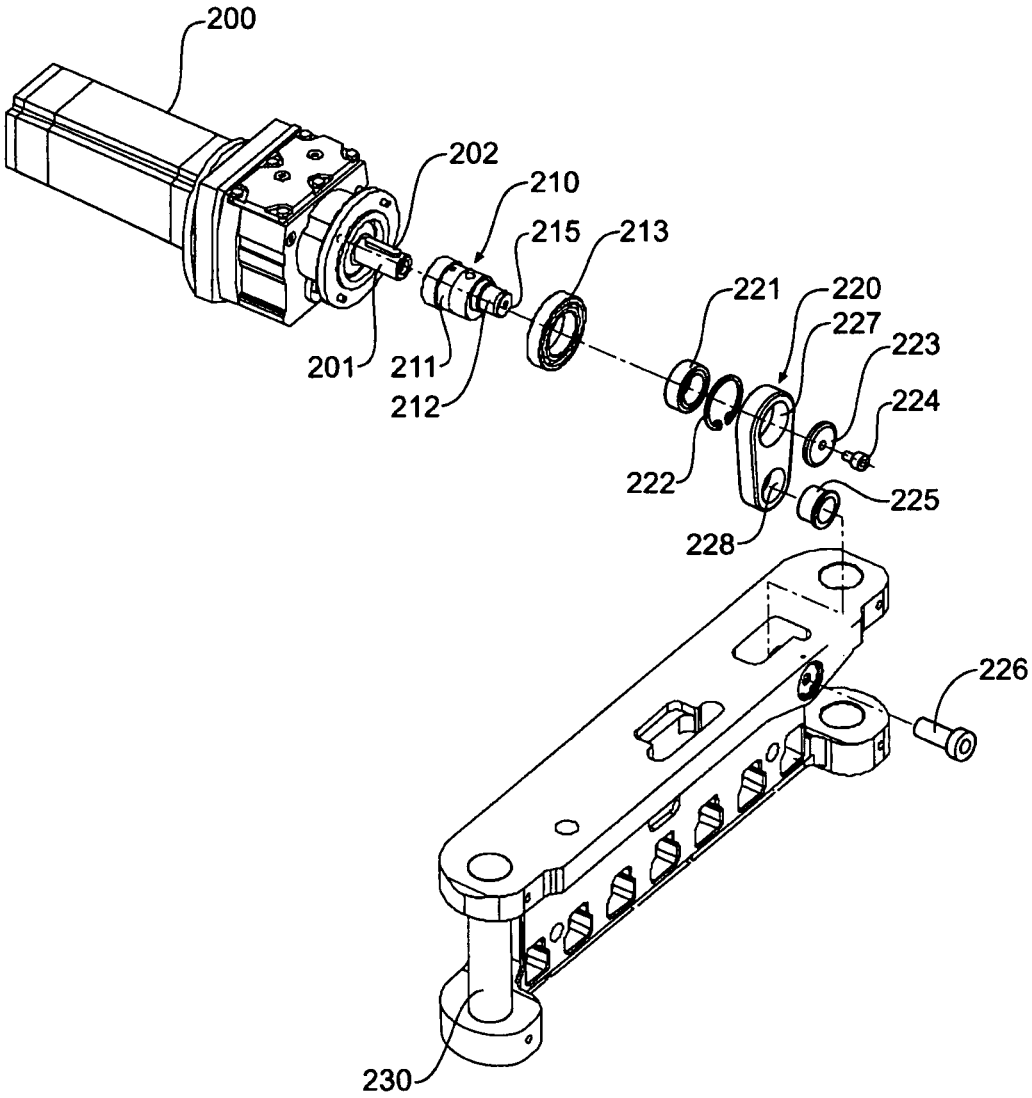
FIG. 10 is an exploded view of the cam shaft and linkage arrangement of the guillotine drive.

The linkage member 220 (the second linkage member) is a straight linkage as illustrated for example in FIG. 10. The second linkage member 220 is connected to second cam shaft 210 through a second cam bearing 221 and to the guillotine platen assembly through a guillotine platen bearing 225, both the second cam bearing 221 and the guillotine platen bearing 225 bisected by the first plane defined above.

The folder platen assembly may also include a clamping member for clamping the strip material prior to folding. As shown in FIG. 7, a clamp bar 160 is secured beneath the folder platen 130, and at the interface between the base of the folder platen 130 and the clamp bar 160 there are located a plurality of compression springs 166. In one embodiment the clamp bar 160 includes a rubber block 165 (for example a polyurethane elastomer) through which the compressive clamping force is transmitted to the strip material 2. The rubber material acts to absorb or minimize vibration and reduce noise as the clamp bar 160 contacts the strip which will help prevent damage to the strip material.

The folder bar 150 is fastened to an adjustable support plate 140 which is mounted to the front of the folder platen 130. The support plate 140 is adjustably mounted to the folder platen 130 providing ability to adjust the vertical position of the folder bar 150. The support plate 140 is located on cam followers 175 which maintain the alignment of the support plate 140 and allow up and down vertical adjustment. In one embodiment the adjustability is provided by thumb wheels 170 mounted through the folder platen 130 which, in use, are turned to move the support plate 140 up and down. This adjustability can vary how far the folder bar 150 travels on its down stroke, which can directly determine the quality of fold produced for certain fold angles. In one embodiment, the support plate 140 is formed by two interlocking plates, each with adjustability which can be advantageous when processing two strips simultaneously. In this embodiment, the folder bar 150 comprises two separate bars which each mount to one respective support plate 140.

In operation, as the folder platen 130 traverses downwards, the clamp bar 160 will first contact the strip and the springs 166 will act to apply a compressive clamping force to hold the strip 2 in position for the folder bar 150 to bend the material. As the folder platen 130 traverses further to the bottom of its stroke, the springs 166 are compressed further, allowing the folder bar 150 to travel below the clamp bar 160 and produce the bend or fold. The folding operation is performed about the edge of a carbide block 251 which is mounted into a recess in the lower blade holder 250. As the folder bar 150 is lowered, it contacts the strip material 2 at predetermined positions and produces a fold. The strip material 2 bends around the edge of the carbide block 251 and is formed by the folder bar 150 which has a defined radius of curvature about its folding edge. As the strip material 2 is fed through the head assembly 40, a plurality of folds are made at predetermined positions before the strip 2 is cut and a lamination 4 is produced.

Figure 9:
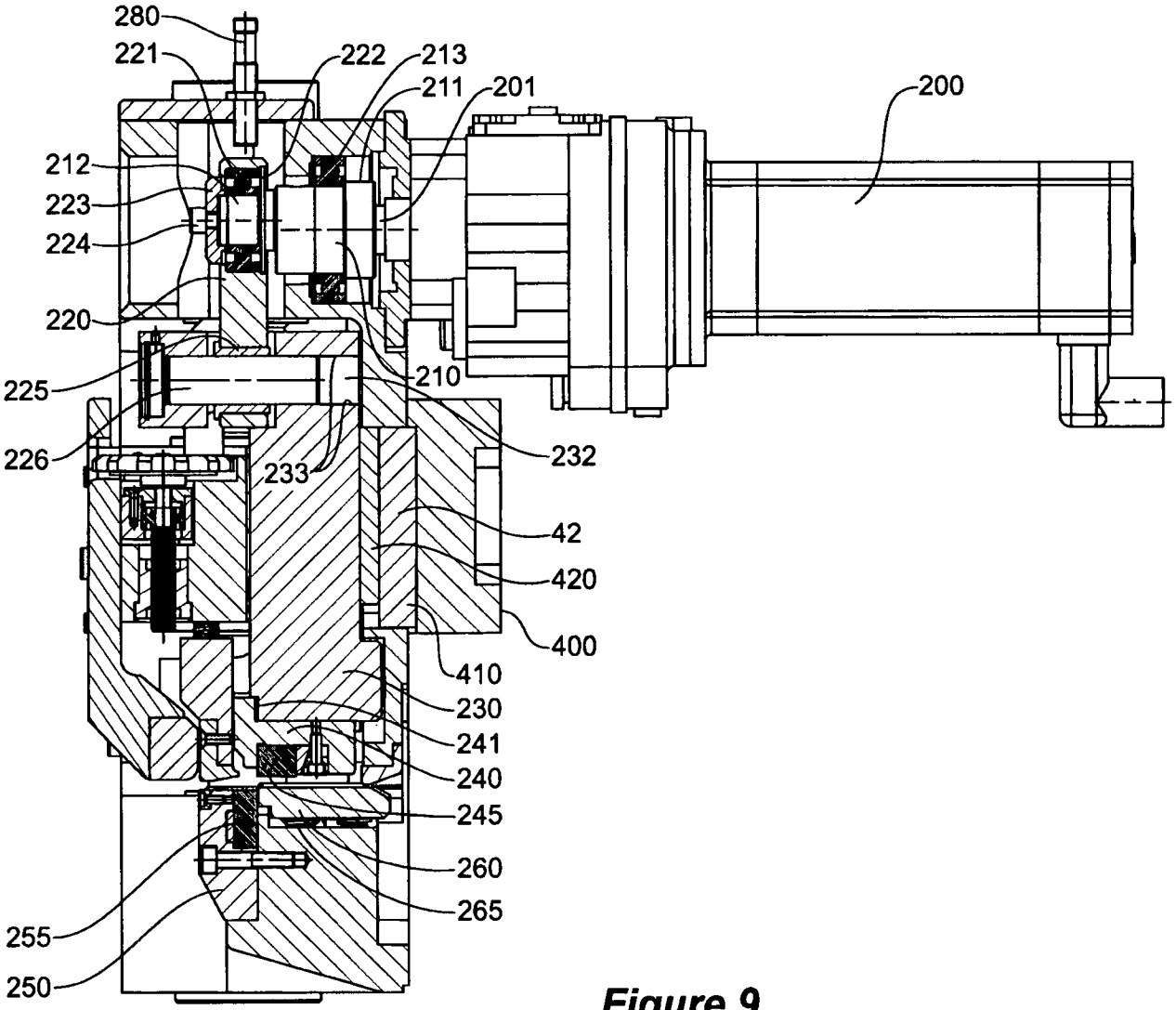
FIG. 9 is a sectional view through B-B of FIG. 5 showing the guillotine drive mechanism.

Referring now to FIG. 9 there is shown a sectional view through B-B of FIG. 5 through the guillotine drive mechanism. The electric actuator 200 is shown mounted onto the rear of the head frame 42. The electric actuator 200 may be any suitable electric motor, but preferably a servo motor. A servo motor advantageously provides the requisite level of control and accuracy while still providing sufficient power and torque. An eccentric cam shaft 210 is securably mounted onto the output shaft 201 of the servo motor 200. The output shaft 201 of the motor 200 has a raised key element 202 which slidably engages into an internal keyway (not shown) of the cam shaft 210. Through this connection the key 202 prevents relative rotation between the two parts and allows torque to be transmitted from the motor 200 to the cam shaft 210. A grub screw (not shown) is used to lock the cam shaft 210 onto the output shaft 201 of the motor 200 through a threaded hole in the cam shaft 210. The cam shaft 210 is rotatably supported by ball bearing 213 that is housed in head frame 42.

Figure 13:
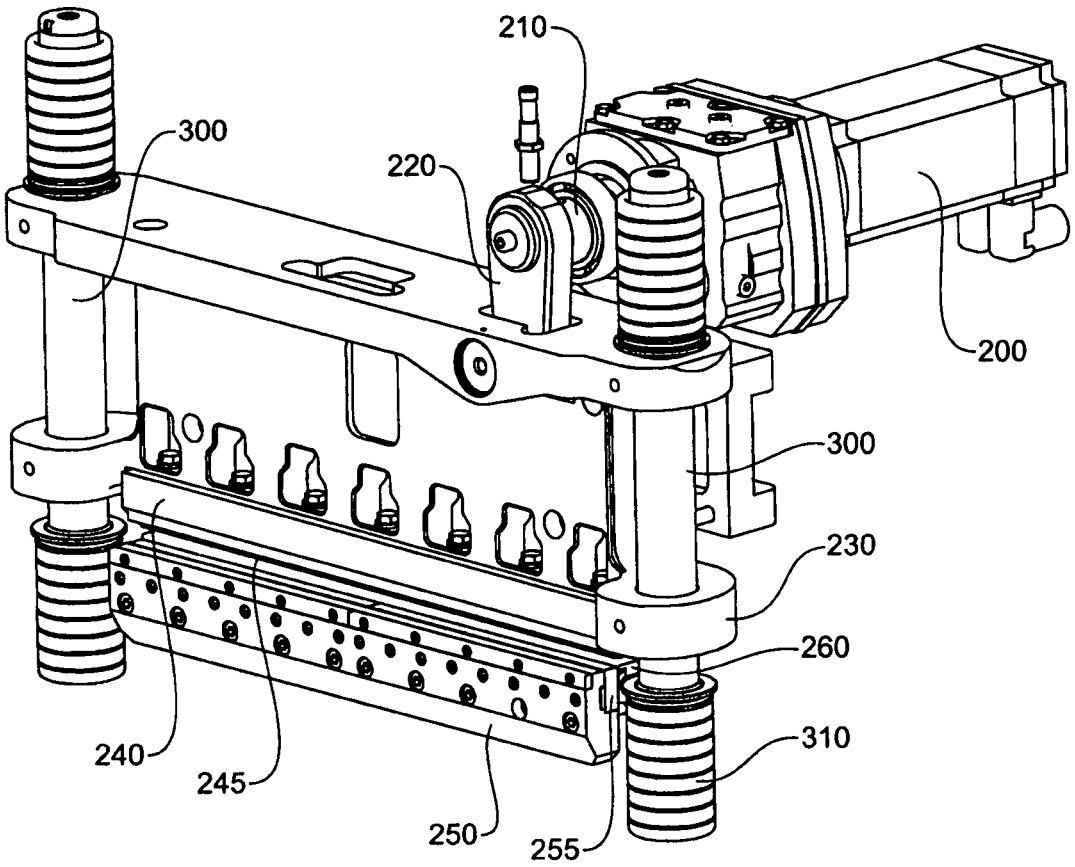
FIG. 13 is a perspective view of the head assembly showing detail of the guillotine drive mechanism.

The cam shaft 210 is connected to a linkage member or rocker arm 220. This connection is illustrated most clearly in FIG. 10 which shows an exploded view of the cam shaft 210 and linkage arrangement of the folder drive. FIG. 13 also provides detail of the guillotine drive arrangement (with folder drive not shown). The cam shaft 210 comprises an elongate shank portion 211 and a radially offset or eccentric cam pin 212. The linkage member 220 includes a first aperture 227 and a second aperture 228. The cam pin 212 is inserted through the first aperture 227 of the linkage member 220, and is rotatable within ball bearing 221 that is mounted within the first aperture 227 of the linkage member 220 and held by an internal circlip 222. The cam shaft 210 is secured to the linkage member 220 by a link retainer or washer 223 that is mounted onto the surface of the linkage member 220 surrounding the first aperture 227. A suitable fastener, for example a socket head screw is fastened through a threaded hole of the link retainer 223 and into a threaded hole 215 in the cam pin 212. This connection facilitates a direct coupling between the cam shaft 210 and the linkage member 220 such that as the cam shaft 210 rotates, the linkage member 220 is driven between an uppermost position and a lowermost position in a reciprocal manner.

The guillotine platen assembly is coupled to the linkage member 220 via a coupling element 226 that is inserted through the second aperture 228 of the linkage member 220. The coupling element 226 may be an elongate pin element. The coupling element 226 is inserted through a passageway 232 located in the guillotine platen 230 and is supported by a bush 225 located in the second aperture 228 of the linkage member 220. The outer surface of the coupling member 226 bears against the internal walls 233 of the passageway 232 of the guillotine platen 230. Therefore, as the linkage member 220 is lowered or raised, the coupling member 226 exerts a bearing force onto the passageway 232 of the guillotine platen 230, resulting in a lowering or lifting of the guillotine platen 230.

The guillotine platen 230 accommodates the mounting of an upper blade holder 240 which is adjustably mounted to the base of the guillotine platen 230. An upper cutting blade 245 is mounted in the upper blade holder 240 such that the cutting edge extends below the blade holder 240. In one embodiment the blade may be made from carbide. Mounting of the upper blade holder 240 is adjustable in the fore-aft direction with respect to the head assembly 40. Adjustment is achieved by die springs 241 which act between a lip of the upper blade holder 240 and the guillotine platen 230. The purpose of this adjustment is to obtain the desired separation between the upper cutting blade 245 and lower cutting blade 255. It has been found that a blade clearance of about 12 microns provides the machine 10 with optimal cutting characteristics. If the clearance exceeds about 12 microns the likelihood of a cut with burring increases and if the clearance is less than about 12 microns the likelihood of blade chipping increases.

As the guillotine platen 230 is lowered, the upper blade 245 will contact the strip material 2 immediately above a lifter plate 260. The guillotine platen 230 will compress the lifter plate 260 which is mounted on compression springs 265. As the guillotine platen 230 is driven further down towards the bottom of its stroke, the strip material 2 which is sandwiched between the upper blade 245 and lifter plate 260 will be forced beneath the edge of the lower blade 255. This will shear the material right through and create a clean cut at a predetermined position. After the cut has been made, the guillotine platen 230 begins to rise and the compression springs 265 act to raise or lift the lifter plate 260 up above the lower blade 255. This lifting raises the strip 2 above the edge of the lower blade 255 and prevents the strip 2 which is being continuously fed to the head assembly 40 from catching on the rear side of the lower blade 255. As the strip material 2 fed to the head assembly 40 is from a wound coil, it has a tendency to coil or flick up even when unwound. To prevent this occurrence the upward stroke of the guillotine platen 230 may be limited such that the space wherein the strip 2 may have a tendency to want to warp or lift up is taken up by the upper blade holder assembly. This is another advantage of having an electric cam driven platen, as it is possible to accurately control the stroke of the platen.

Figure 11:
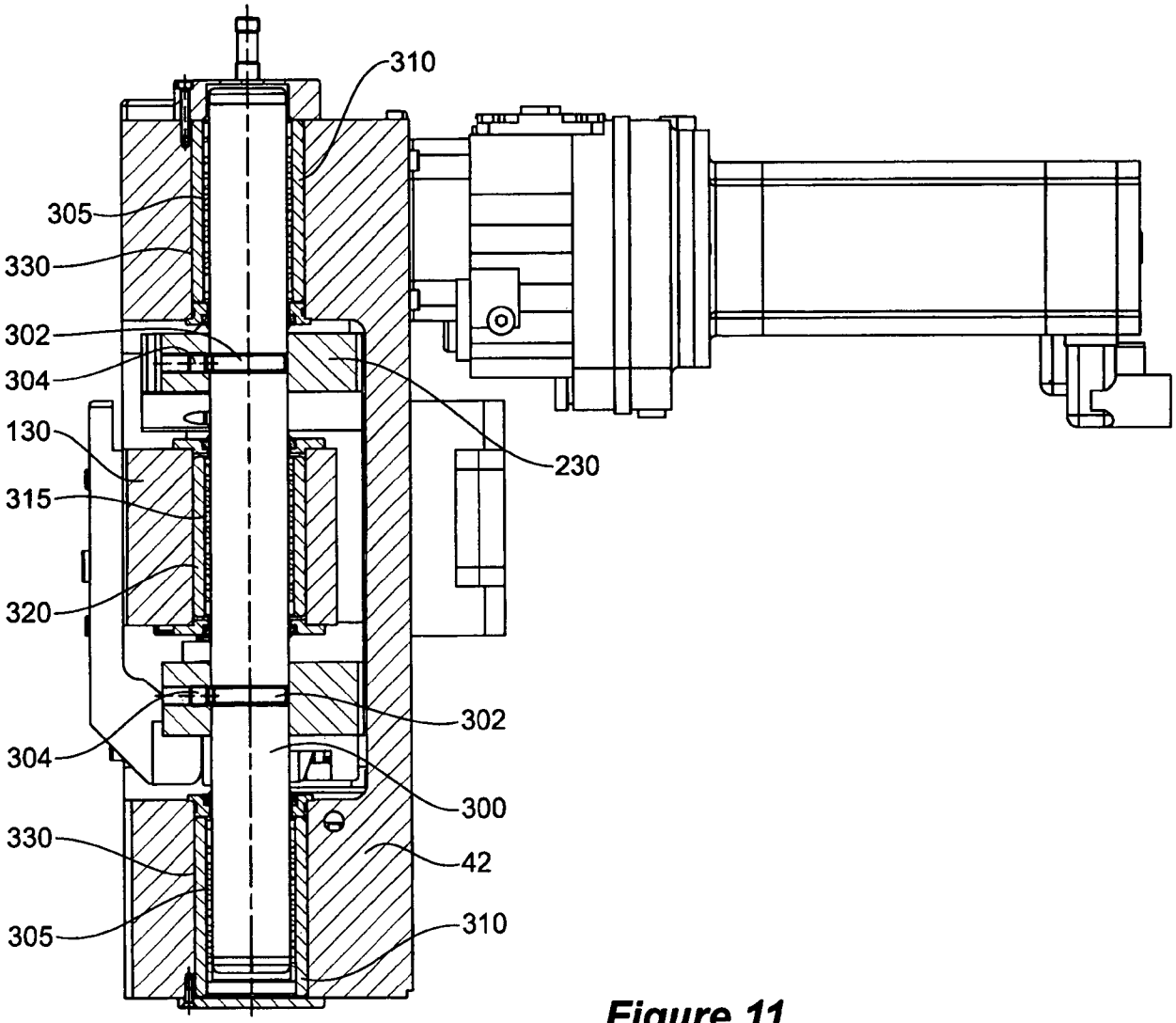
FIG. 11 is a sectional view through C-C of FIG. 5 showing one of the main guide shafts.

Referring now to FIG. 11 there is shown a sectional view through C-C of FIG. 5 through the main guide shafts 300. The shafts 300 are received in apertures 330 in laterally opposed portions of the head frame 42. The shafts 300 are supported by bushes 310 inserted into apertures 330 of the head frame 42. Inserted inside the bushes 310 are peened ball cages 305 which are slidably engaged with the shafts 300. In one embodiment, the shafts 300 may be keyed to the cages 305 so that the shafts 300 and cages 305 move together, slidably inside the bushes 310. Alternatively, the cages 305 may be secured inside the bushes 310 by an interference fit such that the cages 305 remain stationary while the shafts 300 are slidable inside the cages 305. The shafts 300 are for the purpose of supporting the traverse of both the folder platen 130 and guillotine platen 230. The guillotine platen 230 locates onto the shafts 300 and may be coupled to the shafts 300 by screws 304 which locate through the guillotine platen 230 and into grooves 302 machined into the shafts 300. Screws 304 couple the movement of the guillotine platen 230 to the shafts 300, such that as the guillotine platen 230 traverses up and down, the shafts 300 also move up and down inside the cages 305. The folder platen 130 also locates onto the shafts 300 but is not locked or keyed onto the shafts 300 as the guillotine platen 230 is. The folder platen 130 is slidably engaged with the shafts 300 such that the folder platen 130 is slidably movable with respect to the shafts 300. A bush 320 and peened ball cage 315 is retained in shaft receiving portions of the folder platen 130 to facilitate this relative sliding.

Figure 14A:
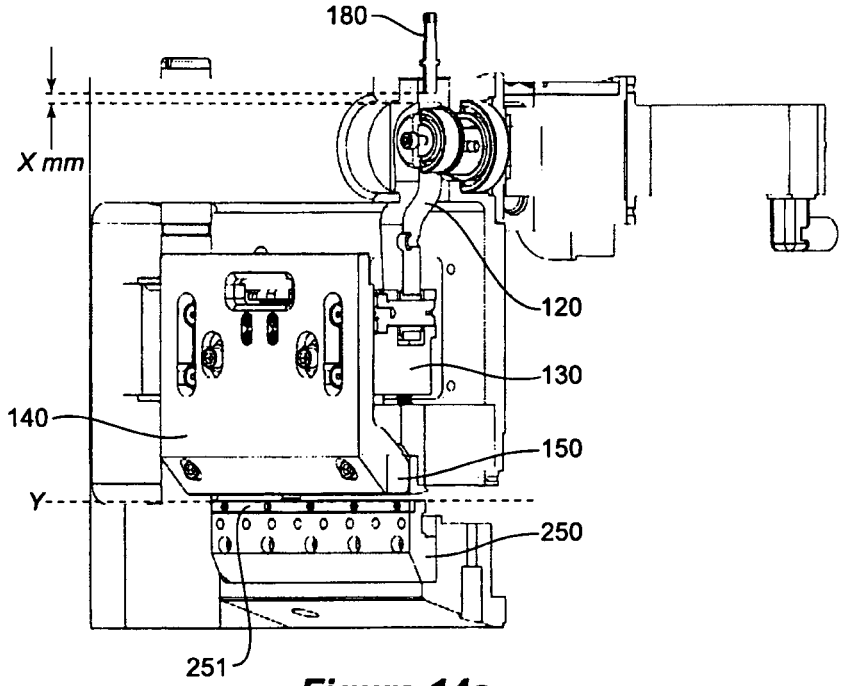
FIGS. 14*a*-14*d* depict a sequence of sectional views through the folder drive mechanism showing the cam shaft at 0° (Top Dead Centre (TDC)), 90°, 180° and 270° respectively.
Figure 14B:
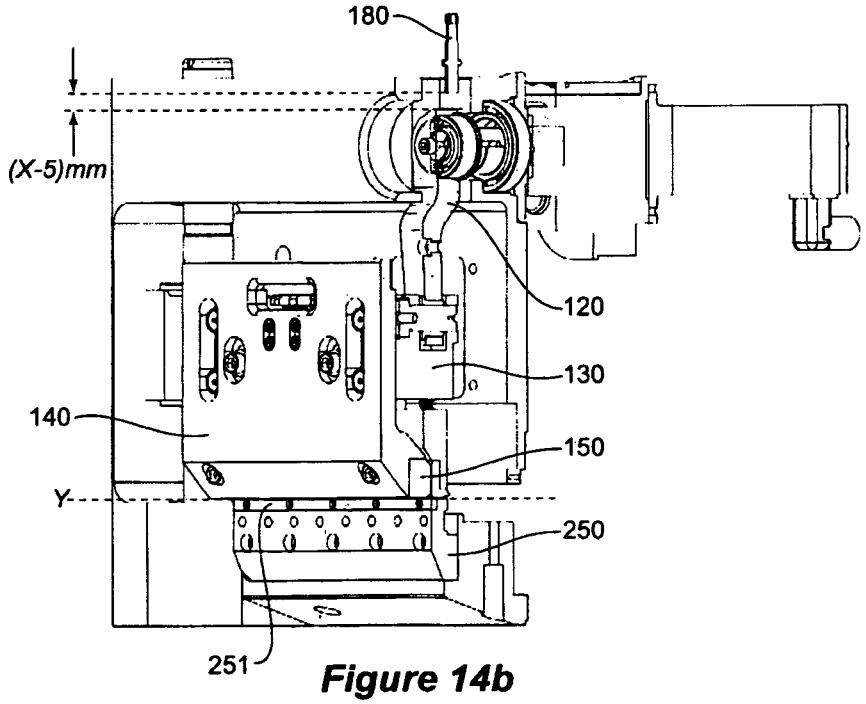
Figure 14C:
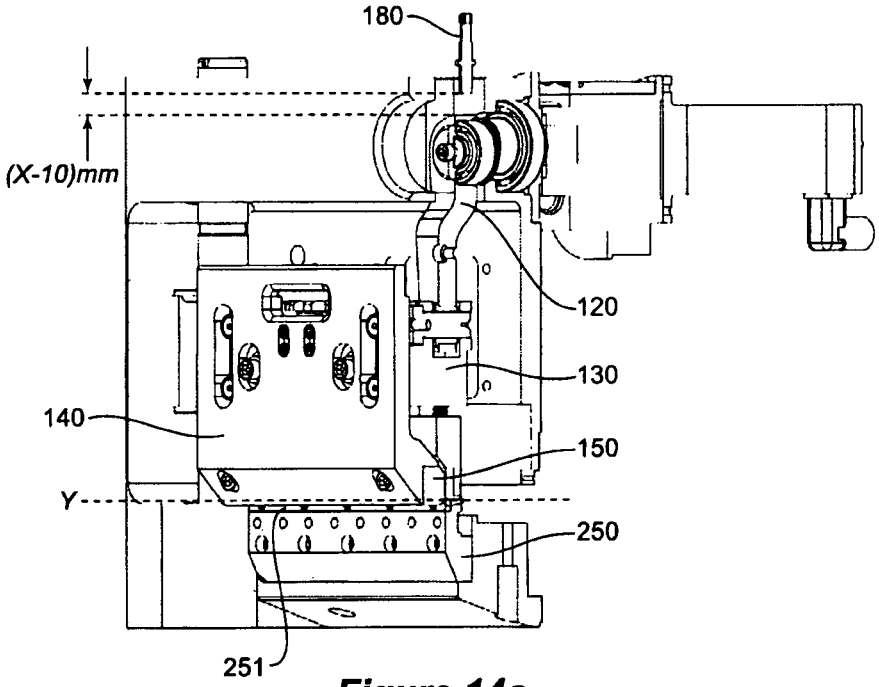
Figure 14D:
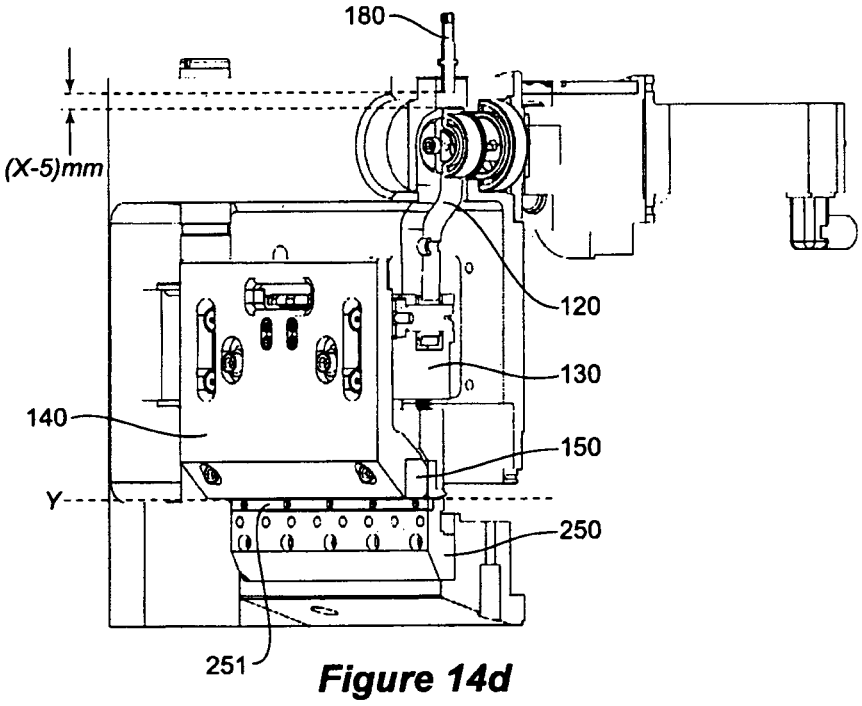

Referring now to FIGS. 14*a*-14*d*, there is shown a sequence of views of the folder drive mechanism in operation. FIGS. 14*a*-14*d* illustrate the position of the folder platen 130 and folder bar 150 as the cam shaft 110 rotates through 0° (Top Dead Centre (TDC)), 90°, 180° (Bottom Dead Centre (BDC)) and 270°. There is a 5 mm eccentricity or offset between the longitudinal axis of the shank portion 111 of the cam shaft 110 (attached to the output shaft 101 of the motor 100), and the longitudinal axis of the cam pin 112 (coupled to the first aperture 127 of the linkage member 120). This eccentricity results in a total stroke or travel of the folder platen 130 of 10 mm between the TDC position of the cam pin 112 and the bottom dead centre (BDC) position. Mounted onto a plate directly above the linkage 120 is an inductive proximity switch 180 which detects when the cam pin 112 and linkage member 120 are at the TDC position and inputs this information to a programmed controller. In FIG. 14*a*, the cam shaft 110 is at 0° (TDC) and the folder platen assembly is shown in its uppermost position. The support plate 140 and folder bar 150 are located above the top surfaces of the lower blade holder 250 and carbide block 251, the top surfaces located in horizontal datum plane Y. The vertical separation between the top of the linkage member 120 and the bottom of the proximity switch 180 defined as xmm. FIG. 14*b* depicts the cam shaft 110 rotated through 90°. The folder platen assembly has been lowered 5 mm (the eccentric offset) so that the separation between the top of the linkage member 120 and the bottom of the proximity switch 180 is now (x−5) mm. The base of the folder bar 150 is now substantially level with the top surface of the carbide block 251 (i.e. co-planar with horizontal datum plane Y). FIG. 14*c* depicts the cam shaft 110 at 180° (BDC) and the folder platen assembly at its lowermost position. The folder platen assembly has now been lowered 10 mm so that the separation between the top of the linkage member 120 and the bottom of the proximity switch 180 is now (x−10) mm. In this position, the folder bar 150 has been lowered below horizontal datum plane Y and the strip 2 being fed through the head assembly 40 will have been folded about the carbide block 251. FIG. 14*d* depicts the cam shaft 110 at 270° and shows the folder platen assembly moving upwards from BDC back towards TDC. The separation between the top of the linkage member 120 and the bottom of the proximity switch 180 is now (x−5) mm and the base of the folder bar 150 is again substantially aligned with horizontal datum plane Y. FIGS. 14*a*-14*d* further illustrate that as the cam shaft 110 and linkage member 120 are rotated, a reciprocating linear motion is imparted to the folder drive assembly.

Figure 15A:
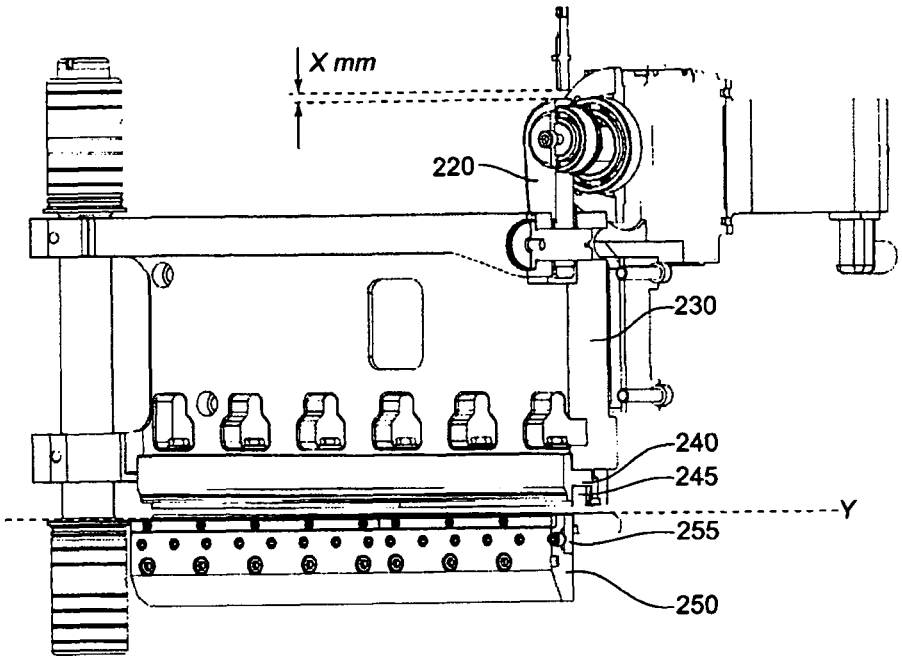
FIGS. 15*a*-15*d* depict a sequence of sectional views through the guillotine drive mechanism showing the cam shaft at 0° (Top Dead Centre (TDC)), 90°, 180° and 270° respectively.
Figure 15B:
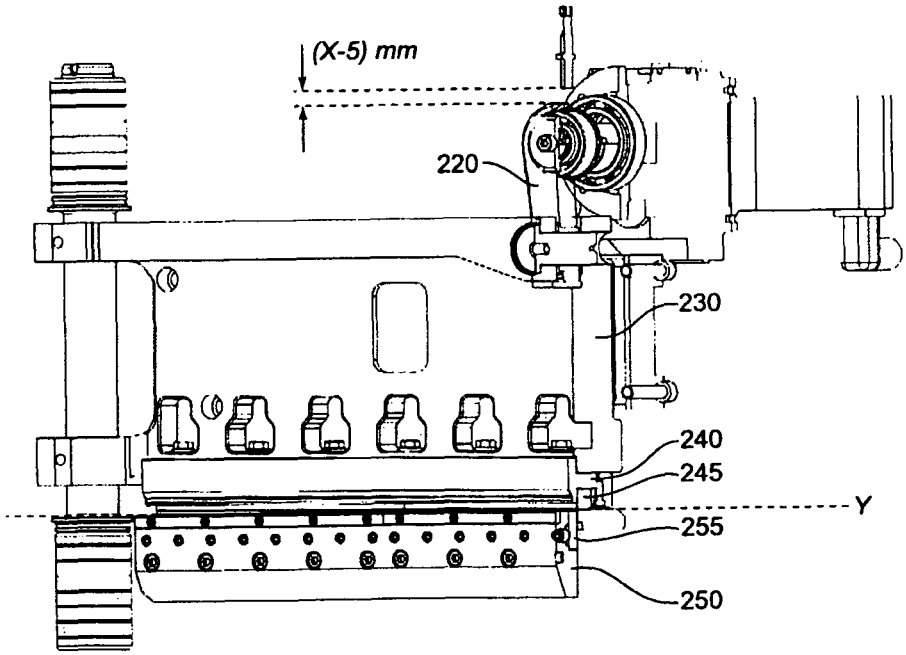
Figure 15C:
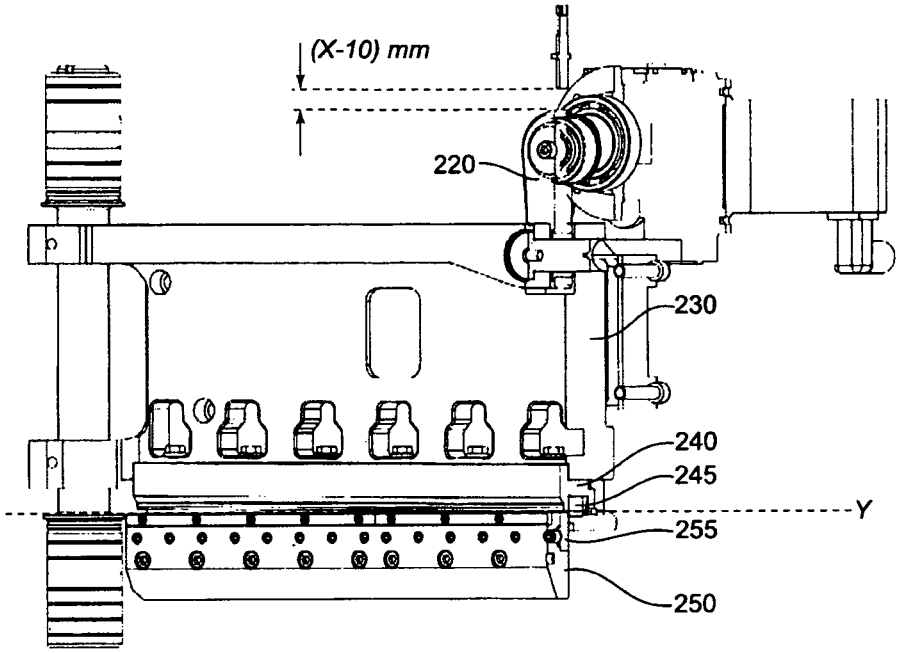
Figure 15D:
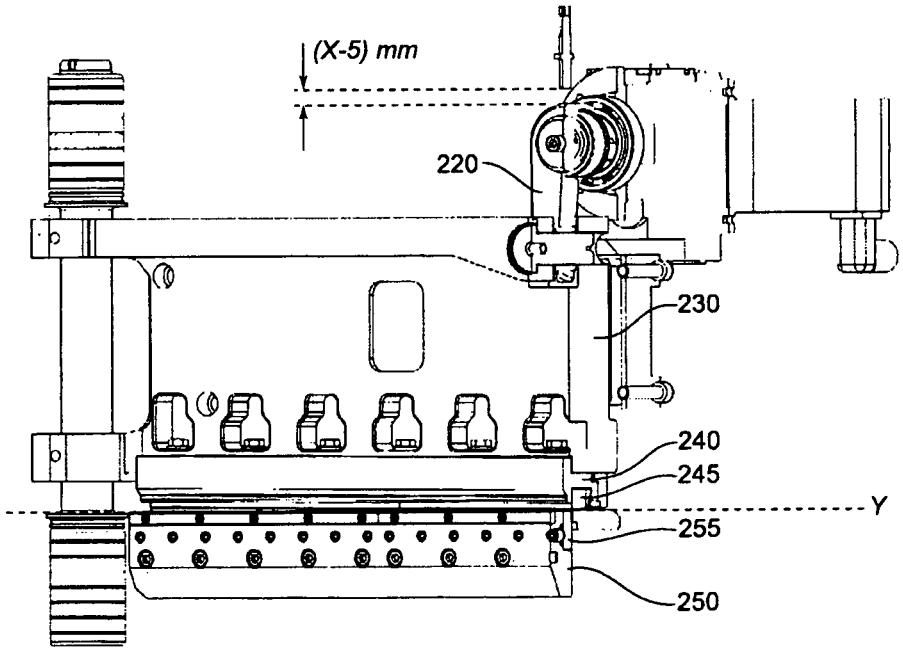

Referring now to FIGS. 15*a*-15*d*, there is shown a sequence of views of the guillotine drive mechanism in operation. FIGS. 15*a*-15*d* illustrate the position of the guillotine platen 230 and upper cutting blade 245 as the cam shaft 110 rotates through 0° (Top Dead Centre (TDC)), 90°, 180° (Bottom Dead Centre (BDC)) and 270°. There is a 5 mm eccentricity or offset between the longitudinal axis of the shank portion 211 of the cam shaft 210 (attached to the output shaft 201 of the motor 200), and the longitudinal axis of the cam pin 212 (coupled to the upper aperture 227 of the linkage member 220). This eccentricity results in a total stroke or travel of the guillotine platen 230 of 10 mm between the TDC position of the cam pin 212 and the BDC position. Mounted onto a plate directly above the linkage member 220 is an inductive proximity switch 280 which detects when the cam pin 212 and linkage member 220 are at the TDC position and inputs this information to a programmed controller. In FIG. 15*a*, the cam shaft 210 is at 0° (TDC) and the guillotine platen assembly is shown in its uppermost position. The upper blade holder 240 and upper cutting blade 245 are located above the top surfaces of the lower blade holder 250, carbide block 251 and lower cutting blade 255, the top surfaces located in horizontal datum plane Y. The vertical separation between the top of the linkage member 220 and the bottom of the proximity switch 280 defined as xmm. FIG. 15*b* depicts the cam shaft 210 rotated through 90°. The guillotine platen assembly has been lowered 5 mm (the eccentric offset) so that the separation between the top of the linkage member 220 and the bottom of the proximity switch 280 is now (x−5) mm. The base of the upper cutting blade 245 is now substantially level with the top surface of the lower cutting blade 255 (i.e. co-planar with horizontal datum plane Y). FIG. 15*c* depicts the cam shaft 210 at 180° (BDC) and the guillotine platen assembly at its lowermost position. The guillotine platen assembly has now been lowered 10 mm so that the separation between the top of the linkage member 220 and the bottom of the proximity switch 280 is now (x−10) mm. In this position, the base of the upper cutting blade 245 has been lowered below horizontal datum plane Y and the strip 2 being fed through the head assembly 40 will have been cut or sheared between lower cutting blade 255. FIG. 15*d* depicts the cam shaft 210 at 270° and shows the guillotine platen assembly moving upwards from BDC back towards TDC. The separation between the top of the linkage member 220 and the bottom of the proximity switch 280 is now (x−5) mm and the base of the upper cutting blade 245 is again substantially aligned with horizontal datum plane Y. FIGS. 15*a*-15*d* further illustrate that as the cam shaft 210 and linkage member 220 are rotated, a reciprocating linear motion is imparted to the guillotine drive assembly.

It will be understood that the term "comprise" and any of its derivatives (e.g. comprises, comprising) as used in this specification is to be taken to be inclusive of features to which it refers, and is not meant to exclude the presence of any additional features unless otherwise stated or implied.

The reference to any prior art in this specification is not, and should not be taken as, an acknowledgment or any form of suggestion that such prior art forms part of the common general knowledge of the technical field.

While the present invention has been described in terms of preferred embodiments in order to facilitate better understanding of the invention, it should be appreciated that various modifications can be made without departing from the principles of the invention. Therefore, the invention should be understood to include all such modifications within its scope.

What is claimed is:

1. A machine for manufacturing stackable laminations for a magnetic core, the laminations formed from magnetic strip material, the machine including:

a frame for housing a folder platen assembly and a guillotine platen assembly;

a folder platen assembly having a folder bar for folding said strip material in at least one pre-determined position;

a guillotine platen assembly having a cutting blade for cutting said strip material at a pre-determined position;

a first electric actuator;

a second electric actuator;

a first cam shaft driven by the first electric actuator and coupled to the folder platen assembly by a first linkage member, the first cam shaft rotatable about a first axis; and a second cam shaft driven by the second electric actuator and coupled to the guillotine platen assembly by a second linkage member, wherein, the first linkage member comprises:

a first portion connected to the first cam shaft through a first cam bearing and a second portion connected to the folder platen assembly through a folder platen bearing, the first cam bearing bisected by a first plane perpendicular to the first axis and the folder platen bearing bisected by a second plane perpendicular to the first axis, the first and second planes offset from each other.

2. The machine as claimed in claim 1 wherein the second linkage member is a straight linkage member connected to the second cam shaft through a second cam bearing and to the guillotine platen assembly through a guillotine platen bearing, both the second cam bearing and the guillotine platen bearing bisected by the first plane.

3. The machine as claimed in claim 1 wherein the second plane is disposed forward of the first plane.

4. The machine as claimed in claim 3 wherein the first and second portions of the first linkage member are stepped apart.

5. The machine as claimed in claim 1 wherein the folder platen assembly and guillotine platen assembly are independently and reciprocally drivable between respective uppermost and lowermost positions.

6. The machine as claimed in claim 1 wherein the guillotine platen assembly has a movable upper cutting blade and a fixed lower cutting blade that cooperate to cut the strip material by shearing between the respective blades.

7. The machine as claimed in claim 1 wherein the folder platen assembly further includes a clamping member for clamping the strip material prior to folding.

8. The machine as claimed in claim 1 wherein the first linkage member and folder platen assembly are coupled by a first pin element.

9. The machine as claimed in claim 8 wherein the second linkage member and guillotine platen assembly are coupled by a second pin element.

10. The machine as claimed in claim 1 wherein the folder platen assembly and guillotine platen assembly locate onto a pair of shafts that are housed in laterally opposed portions of the frame.

11. The machine as claimed in claim 8 wherein the folder platen assembly is slidably movable along the shafts.

12. The machine as claimed in claim 8 wherein the guillotine platen assembly is fixedly engaged to the shafts such that the guillotine platen and shafts are movable in unison.

13. The machine as claimed in claim 1 wherein at least one of the first or second electric actuators is a servo motor.

* * * * *